US008336603B2

(12) United States Patent
Bischoff et al.

(10) Patent No.: US 8,336,603 B2
(45) Date of Patent: Dec. 25, 2012

(54) OXIDE RESTRAINT DURING CO-CASTING OF METALS

(75) Inventors: Todd F. Bischoff, Spokane Valley, WA (US); Randy Womack, Spokane Valley, WA (US); Wayne J. Fenton, Spokane Valley, WA (US); Robert Bruce Wagstaff, Spokane Valley, WA (US); Lawrence G. Hudson, Pulaski, NY (US)

(73) Assignee: Novelis Inc., Toronto, Ontario (CA)

( * ) Notice: Subject to any disclaimer, the term of this patent is extended or adjusted under 35 U.S.C. 154(b) by 585 days.

(21) Appl. No.: 12/454,655

(22) Filed: May 21, 2009

(65) Prior Publication Data

US 2009/0288795 A1 Nov. 26, 2009

Related U.S. Application Data

(60) Provisional application No. 61/128,848, filed on May 22, 2008.

(51) Int. Cl.
*B22D 11/00* (2006.01)
*B22D 11/12* (2006.01)
*B22D 11/124* (2006.01)

(52) U.S. Cl. ..... 164/461; 164/444; 164/487; 164/437

(58) Field of Classification Search ..... 164/461, 164/487, 437, 444, 503, 467
See application file for complete search history.

(56) References Cited

U.S. PATENT DOCUMENTS

| | | | | |
|---|---|---|---|---|
| 3,779,389 | A | 12/1973 | Fant | |
| 4,724,896 | A | 2/1988 | Rose et al. | |
| 6,260,602 | B1 | 7/2001 | Wagstaff | |
| 6,705,384 | B2 | 3/2004 | Kilmer et al. | |
| 7,243,702 | B2 | 7/2007 | Izu et al. | |
| 7,398,817 | B2 * | 7/2008 | Capotosti et al. | 164/428 |
| 7,472,740 | B2 * | 1/2009 | Anderson et al. | 164/461 |
| 2005/0011630 | A1 | 1/2005 | Anderson et al. | |
| 2005/0126743 | A1 * | 6/2005 | Izu et al. | 164/480 |

FOREIGN PATENT DOCUMENTS

| | | | |
|---|---|---|---|
| EP | 1 450 972 | B1 | 1/2004 |
| JP | 52086926 | A2 | 7/1977 |
| JP | 03-066450 | | 3/1991 |
| SU | 665000 | A * | 5/1979 |

OTHER PUBLICATIONS

Machine Translation of SU 665000 A. Gladkov N A et al. May 1979.*

Canadian Intellectual Property Office, International Search Report, Sep. 4, 2009, Int'l Appl'n No. PCT/CA2009/000690 (Novelis Inc. et al.).

* cited by examiner

*Primary Examiner* — Kevin P Kerns
*Assistant Examiner* — Steven Ha
(74) *Attorney, Agent, or Firm* — Cooper & Dunham LLP

(57) ABSTRACT

A method and apparatus is disclosed for casting a composite ingot made of metals that are susceptible to surface oxide formation when molten. The method involves co-casting at least two metal layers from at least two molten metal pools formed within a direct chill casting apparatus. During the casting operation, movement of metal oxide formed on the upper surface of at least one of the pools towards an edge of the pool is restrained by an oxide skimmer positioned close to an edge of the pool above an external surface or metal-metal interface of the ingot. The apparatus provides a DC caster with at least one oxide skimmer that operates in this manner.

12 Claims, 7 Drawing Sheets

OXIDE RESTRAINT DURING CO-CASTING OF METALS

CROSS-REFERENCE TO RELATED APPLICATION

This application claims the priority right of prior co-pending provisional patent application Ser. No. 61/128,848 filed May 22, 2008 by applicants herein.

BACKGROUND OF THE INVENTION (1) Field of the Invention

This invention relates to the casting of metals, particularly (although not exclusively) aluminum and aluminum alloys. More particularly, the invention relates to the co-casting of metal layers by direct chill casting techniques.

(2) Description of the Related Art

Metal ingots are commonly produced by direct chill (DC) casting of molten metals. This involves pouring a molten metal into a mold having cooled walls, an open upper end and (after start-up) an open lower end. The metal emerges from the lower end of the mold as a solid metal ingot that descends and elongates as the casting operation proceeds. Such casting techniques are particularly suited for the casting of aluminum and aluminum alloys, but may be employed for other metals too.

Casting techniques of this kind are discussed extensively in U.S. Pat. No. 6,260,602 to Wagstaff, issued on Jul. 17, 2001, which relates exclusively to the casting of monolithic ingots, i.e. ingots made of the same metal throughout and cast as a single layer. It is also known to cast multiple layers of metal in DC casting apparatus. This involves the use of a divider of some kind within the casting mold to create two or more compartments for different metal pools that form different metal layers in the cast ingot. The divider may be a thin metal sheet that is fed continuously into the mold as the casting commences and which becomes incorporated into the cast ingot, or the divider may be a relatively short fixed element or divider wall that remains in place in the entrance to the mold and separates the metals until they are sufficiently solid to contact each other without comingling of the molten metals. Apparatus of the former kind (movable divider) is disclosed, for example, in U.S. Pat. No. 6,705,384 issued on Mar. 16, 2004 to Kilmer et al. (the disclosure of which is incorporated herein by reference). Apparatus of the latter kind (fixed divider wall) may involve simultaneous co-casting of two or more layers or sequential co-casting in which the divider wall is generally cooled. Apparatus for sequential co-casting is disclosed, for example, in U.S. Patent Publication No. 2005/0011630 A1, published on Jan. 20, 2005 in the name of Anderson et al. (the disclosure of which is incorporated herein by reference). Sequential solidification involves the casting of a first layer (e.g. a layer intended as an inner layer or core) and then, subsequently but in the same casting operation, casting one or more layers of other metals (e.g. as cladding layers) on the first layer once it has achieved a suitable degree of solidification.

While these techniques are effective and successful, there is a continuing interest in improving the quality of the cast ingot and, especially, the strength and integrity of the interfacial bond between adjacent layers or between such layers and a divider incorporated into the cast ingot. If the interfacial bond is weak or compromised, layer separation may take place during casting or subsequent rolling of the ingot, or "blisters" may form during ingot annealing. Furthermore, there is also a continuing interest in avoiding the formation of cracks in the outer surface of the cast ingot produced in these ways.

BRIEF SUMMARY OF THE INVENTION

One exemplary embodiment provides apparatus for casting a composite metal ingot, comprising an open ended annular mould having a feed end, an exit end, a cooled mold wall between the feed end and the exit end, and a moveable bottom block adapted to fit within the exit end and to be movable in a direction along the axis of the annular mould. The feed end of the mould is divided into at least two separate feed chambers, each feed chamber being adjacent at least one other feed chamber, and where adjacent pairs of feed chambers are separated by a divider. The apparatus includes a feed device for delivering metal to each feed chamber to form a pool of molten metal in each feed chamber during casting, each pool having an upper surface maintained at a predetermined vertical height. A surface oxide skimmer is provided. The skimmer extends into one of the feed chambers from above, the skimmer having a lower end positioned during casting at or below the predetermined vertical height of the upper surface of the pool of molten metal in the said one feed chamber.

The apparatus preferably has one or more additional surface oxide skimmers descending into the one or another of the feed chambers and each having a lower end positioned below the predetermined vertical height of the metal pool in the one or another of the feed chambers. Preferably, the (or each) surface oxide skimmer is positioned adjacent to a temperature controlled divider wall or adjacent to a cooled mold wall.

Another exemplary embodiment provides a method of casting a composite ingot which comprises co-casting at least two metal layers from at least two molten metal pools formed within a direct chill casting apparatus, wherein the metals of the molten metal pools are susceptible to surface oxide formation. The method involves maintaining an upper surface of each metal pool at a predetermined vertical height during casting, and blocking movement of metal oxide formed on the upper surface of at least one of the pools towards an edge of the pool positioned above an external face or metal-metal interface of the ingot.

Yet another exemplary embodiment provides a skimmer for use in a casting apparatus, the skimmer comprising an elongated strip of material that is both heat insulating and resistant to attack by molten metal. The elongated strip has at least two attachment positions enabling the strip to be attached to an adjacent a mold wall or mold divider wall of a casting apparatus, and has a generally straight lower edge.

DETAILED DESCRIPTION OF THE EXEMPLARY EMBODIMENTS

The present invention may be employed with co-casting of various kinds and is especially effective when used with direct chill casting apparatus of the type described, for example, in U.S. Patent Publication No. 2005/0011630 mentioned above. This kind of apparatus makes it possible to cast metals by sequential solidification to form at least one outer layer (e.g. a cladding layer) on an inner layer (e.g. a core layer) of a metal ingot. For the sake of completeness, apparatus of this kind is briefly described below, although it should be kept in mind that the invention may also be used with other kinds of co-casting apparatus, e.g. apparatus as described in U.S. Pat. No. 6,705,384.

It should be explained that the terms "outer" and "inner" to describe metal layers of an ingot are used herein quite loosely. For example, in a two-layer structure, there may strictly speaking be no outer layer or inner layer as such, but an outer layer is one that is normally intended to be exposed to the environment, to the weather, or to the eye when fabricated into a final product. Also, the "outer" layer is often thinner than the "inner" layer, usually considerably so, and is thus provided as a thin coating or cladding layer on the underlying "inner" layer or core ingot. In the case of ingots intended for hot and/or cold rolling to form sheet articles, it is often desirable to coat both major (rolling) faces of the ingot, in which case there are certainly recognizable "inner" and "outer" layers. The "inner layer" is often referred to as a "core" or "core layer" and the "outer layer(s)" is (or are) referred to as the "cladding" or "cladding layer(s)".

In sequential casting, it is usual to cast the metal with the higher melting point first (i.e. the metal with the higher liquidus temperature), and then to cast the lower melting metal on a self-supporting surface of the higher melting metal. The metal of higher melting point may form a cladding layer, or alternatively the core layer, according to particular ingot designs and end-uses. While cladding layers may be formed on both major surfaces of a core layer, it is sometimes preferable to form a cladding layer on just one of the major surfaces of a core layer.

Figure 1:
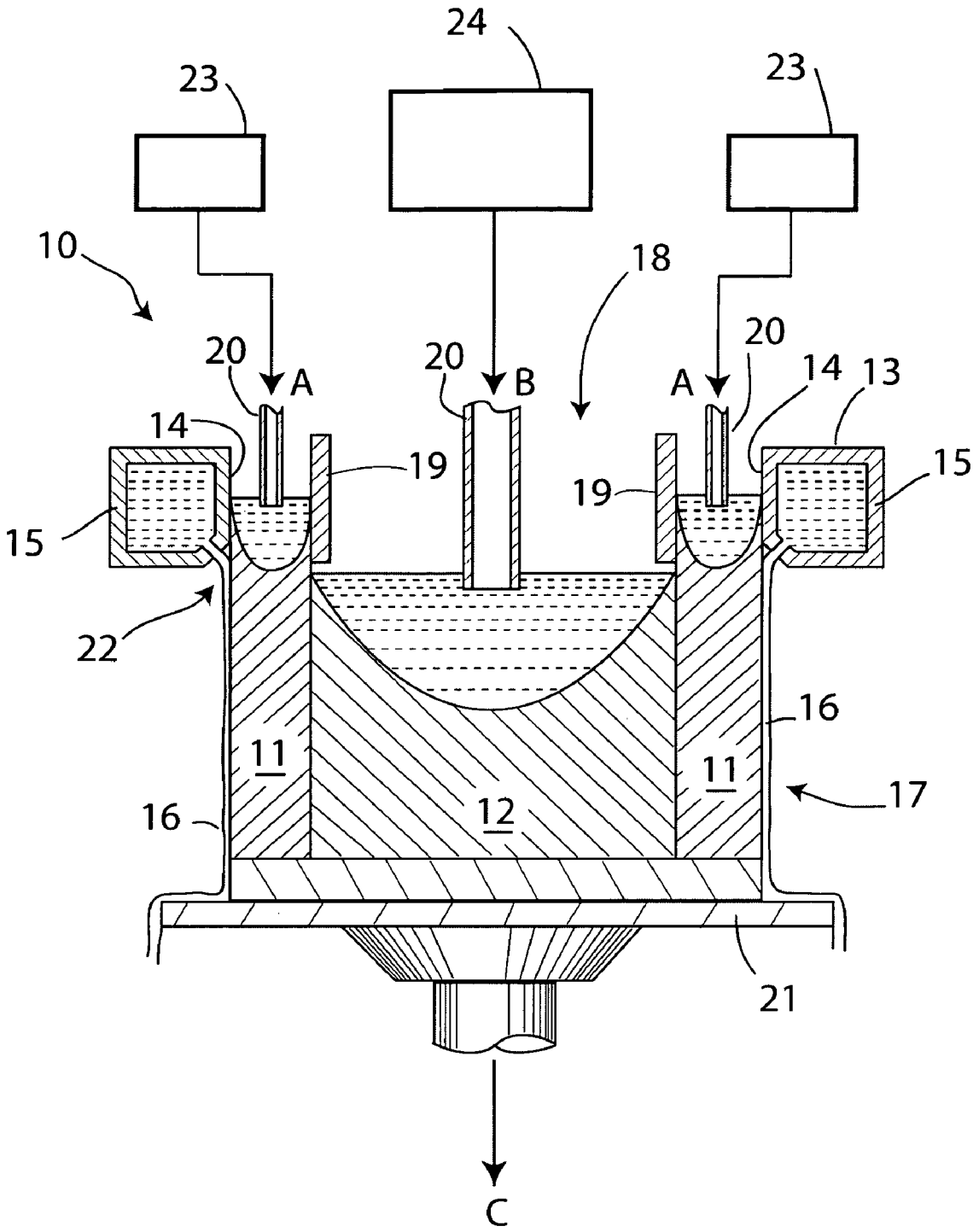
Fig. 1 (Prior Art)
FIG. 1 is a vertical cross-section of a prior art sequential casting mold for casting two coating layers on opposite faces of a core layer, the coating layers being cast first.

FIG. 1 shows an example of a prior art apparatus 10 suitable for sequential co-casting. The illustrated apparatus is used for casting an outer cladding layer 11 on both major side surfaces (rolling faces) of a rectangular inner layer or core layer 12. It will be noticed that, in this version of the apparatus, the outer cladding layers 11 are solidified first (at least partially) during the casting process and then the core layer 12 is cast in contact with the solidified surfaces of the outer layers. In the apparatus shown in FIG. 2, which is also disclosed in the prior art, the core layer 12 is cast first and the outer cladding layers 11 are subsequently cast on the (at least partially) solidified surfaces of the core layer 12. Normally (although not necessarily), the metal used for the two outer layers 11 is the same, and this metal differs from the metal used for the core layer 12. It should also be pointed out that, in the case of both FIG. 1 and FIG. 2, the apparatus may be used for coating just one major surface of the core layer 12 with a cladding layer 11, as will be explained later.

In the following description, reference is made to FIG. 1, but it should be noted that the apparatus of FIG. 2 operates in essentially the same way, except for the reversal of the surface heights of the metal pools provided for the cladding and core layers. The apparatus of FIG. 1 includes a rectangular casting mold assembly 13 that has mold walls 14 forming part of a water jacket 15 from which an encircling stream or streams 16 of cooling water are dispensed onto the external surfaces of an emerging ingot 17. Ingots cast in such apparatus are generally of rectangular cross-section and normally have a size of up to 70 inches wide by 35 inches deep, but larger or smaller ingots may be cast in this way, e.g. ingots of up to 85 inches wide or even wider. They are commonly used for rolling into clad sheet in a rolling mill by conventional hot and cold rolling procedures. It is important to obtain a good degree of adhesion between the inner and outer layers of the ingot to prevent the formation of blisters during ingot annealing and so that layer separation does not occur during casting or rolling or use of the product.

The entry end portion 18 of the mold is separated by dividers formed by divider walls 19 (sometimes referred to as "dividers", "chills" or "chill walls") into (in this embodiment) three feed chambers, one for each layer of a three-layer ingot structure. The divider walls 19, which are often made of copper for good thermal conductivity, are chilled (i.e. cooled or temperature controlled) by means of chilled-water cooling equipment (not shown in FIGS. 1 and 2) contacting the divider walls above the molten metal levels. Consequently, the divider walls cool and solidify the molten metal that comes into contact with them. Similarly, the mold walls 14, which are also water-cooled, cool and solidify molten metal that comes into contact with them. The combined cooling provided by both the mold walls and the divider walls is referred to as "primary" cooling of the metal because it is the cooling most responsible for creating an embryonic solidified ingot that emerges from the mold and because it is the cooling that the metal first encounters as it passes through the mold. As indicated by arrows A, the two side chambers are supplied with the same metal from metal reservoirs 23 and, as indicated by arrow B, the central chamber is supplied with a different metal from a molten metal reservoir 24. Each of the three chambers is supplied with molten metal up to a desired level via separate molten metal delivery nozzles 20 each equipped with an adjustable throttle (not shown) to maintain the upper surface of the resulting molten metal pool at a predetermined vertical height throughout casting. A vertically movable bottom block unit 21 initially closes the open lower end 22 of the mold, and is then lowered during casting (as indicated by the arrow C) while supporting the embryonic composite ingot 17 as it emerges from the mold. The mold thus has a discharge end opening from which the embryonic ingot emerges. The water streams 16 are positioned at a short distance from the discharge end opening and provide "secondary" cooling intended to remove further heat from the embryonic ingot after it emerges from the mold to thereby assure rapid cooling and solidification of the interior of the ingot.

Exemplary embodiments of the present invention are described with reference to apparatus of the above kind, but it should be kept in mind that other exemplary embodiments may be employed with co-casting apparatus of other kinds.

When the metals being cast are susceptible to the formation of surface oxides, which is true of aluminum and aluminum alloys as well as many other metals (e.g. alloys of copper and magnesium), a layer of oxide (which is normally solid at casting temperatures) forms on the upper surfaces of the metal pools in the casting mold. The inventors of the present invention have observed that, in apparatus of this kind, the oxide tends to move during casting in a direction from the centers or center lines of the upper surfaces of the pools towards the outer edges. This may be because of thermal currents formed beneath the upper surfaces of the molten metal as it is being cast or possibly because the metal meniscus adjacent to the mold surfaces 14 or the divider walls 19 turn downwardly and the oxide layer falls under gravity into the depression created by the meniscus. Indeed, the oxide movement may result from a combination of these and other reasons. It has also been observed that the oxide at the edges of the molten metal surface may be drawn down and around the outer surface of the emerging metal layer as the metal descends through the mold. The oxide may therefore coat the newly-forming outer metal face of the ingot or the cladding/core metal-metal interface between the cast layers. In addition to oxide, some metals form solid debris in the form of lumps or precipitates that float at the surface and such solids may also be drawn onto the newly cast faces or interfaces of the ingot. The oxide and metal debris introduced in this way into the metal-metal interface may result in a reduction of the adhesion of the metal layers, i.e. a deterioration of the desired clean metallurgical bond. Also, at least for certain metals, oxide or debris pulled onto the outer face of the ingot can interfere with the cooling dynamics at the mold wall and may lead to the formation of surface cracks in the outer surfaces of the cast ingot. Clearly, effects of these kinds are undesirable.

According to exemplary embodiments of the present invention, movement of surface oxide (and metal debris, if present) on the molten metal pools provided for casting within a DC casting mold is blocked, restrained or held-back, in some or all of the metal pools or at least some of the areas of the metal pools, so that oxide from a central area of the pool is prevented from migrating to one or more edges of the pool surface during casting. This reduces the amount of oxide (and metal debris) available to be drawn down onto one or more of the faces or internal interfaces of the ingot as it is being cast. Of course, oxide may still be formed at the exposed side edges of the metal pools even if the majority of oxide is held back, but in these edge regions the oxide layer tends to be quite thin because the surface metal is quickly drawn down into the mold as the ingot is formed and therefore does not remain exposed to the atmosphere for very long.

As the oxide that forms on the molten metal is less dense than the metal itself, it floats on the molten metal surface. Movement of the floating surface oxide and/or metal debris from the center towards the edges of the metal pool can be physically held back or restrained, for example by means of a solid "skimmer" contacting or dipping into the surface of the pool of molten metal from above. Oxide or other solid debris restrained in this way, especially adjacent to a casting surface of the casting apparatus, is prevented from being drawn onto a newly cast face or metal-metal interface of the cast ingot, and therefore cannot interfere with the desired characteristics of the solid surface or interface as it is formed.

While a preferred physical restraint of this kind is referred to herein as a "skimmer", it should be noted that the skimmer generally remains stationary and does not remove oxide from the metal surface, but merely holds it back from movement on the surface towards an edge region. The device operates as a skimmer in the sense that it restrains oxide moving on a current of molten metal flowing beneath the skimmer, or moving under the effects of gravity caused by a nearby meniscus. The skimmer does not significantly restrain flows of the molten metal taking place beneath the oxide layer. The skimmer may be referred to by other names, such as a "oxide blocker", "baffle", "oxide hold-back device", "oxide containment device", or "oxide restraint" in that it restrains, blocks, holds-back, contains or restrains the movement of oxide from the center to at least one side edge of a metal pool, which movement would take place naturally if not for the presence of such a physical restraint. For convenience, the terms "skimmer" is used henceforth in this description and/or the claims of this specification.

The movement of oxide (and other floating debris) can generally be restrained simply by contacting the oxide layer itself, but the skimmer is preferably pushed through the oxide layer so that it dips into the molten metal of the underlying metal pool. The depth of penetration of the skimmer into the molten metal in this way should preferably be kept to a minimum to avoid exerting undue influence on the flow of molten metal during the casting operation. Thus, molten metal may flow under the skimmer without significant diversion. On the other hand, oxide (and other debris) floating on the surface of the pool cannot bypass the skimmer because the oxide is too low in density to descend into the molten metal to pass beneath the lower end of the skimmer, and the upper end of the skimmer is made to extend too high above the pool surface for the oxide to pass over it. Ideally, the skimmer should project a suitable distance into the molten metal to accommodate any slight variations of the vertical height of the molten metal during the casting operation. Preferably, this distance is up to 8 mm below the surface, more preferably in the range of 3 to 5 mm, and most preferably about 3 mm (e.g. 3 mm±20%) below the upper surface of the molten metal, but different distances may be chosen for casting apparatus of different kinds.

While the skimmer may be of any size or shape, it is preferably in the form of an elongated preferably thin strip or bar of generally rectangular cross-section that is held with its long axis generally horizontal and its short axis generally vertical or gently sloped from the vertical. Most preferably, the skimmer should be thick enough for adequate strength, longevity and resistance to breakage, but not appreciably thicker than needed for these characteristics. As the thickness of the skimmer increases, there is an increasing possibility of undue heat extraction from the molten metal resulting in the formation of undesirable crystalline structures. Also, in some exemplary embodiments, a certain degree of flexing of the skimmer may be desired, so the skimmer should be thin enough to allow for this. The actual thickness will depend on the nature of the material from which the skimmer is formed and the intended design characteristics, but is normally no more than about 3 cm, and preferably no more than 2 cm, more preferably less than 1 cm, and even more preferably about 0.3 cm or even less. In a particularly preferred exemplary embodiment, the bulk of the material of the skimmer has a thickness of 6 mm (or more), but the skimmer has a tapered surface on one side that reduces the thickness to 3 mm at the lower end where the skimmer penetrates the metal. This gives the skimmer good structural strength overall while providing optimal thinness where it contacts the molten metal. Tapered skimmers of this kind may, of course, be provided with other dimensions.

The skimmer generally has a straight lower end so that it dips into the molten metal by the same amount along its length, and is preferably secured to a stationary support at points (generally at least two points) adjacent to its upper end and/or at its longitudinal ends and projects downwardly sufficiently to allow its lower end to dip slightly into the metal pool as already described.

Figure 2:
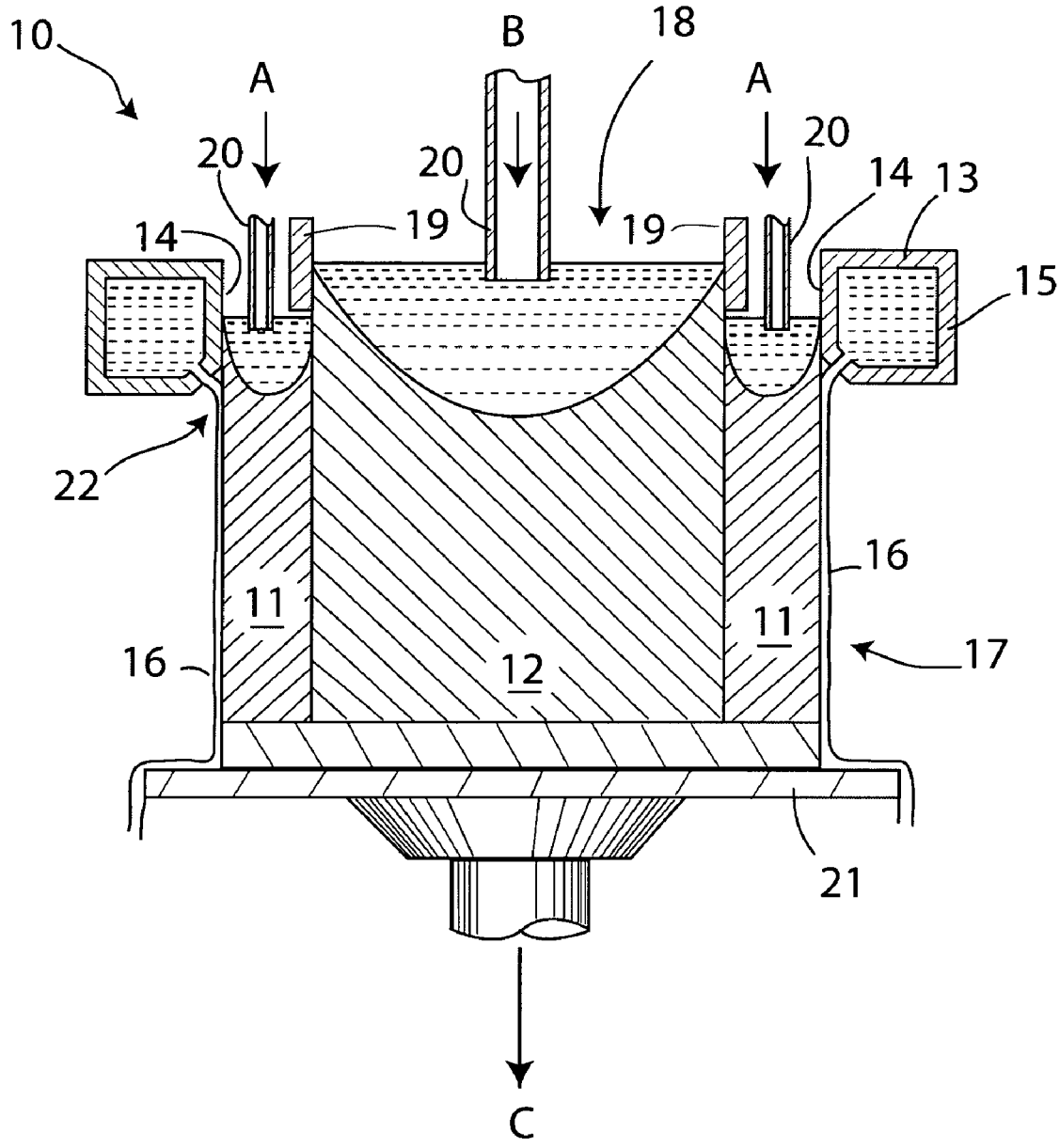
Fig. 2 (Prior Art)
FIG. 2 is a cross-section of a prior art mold similar to that of FIG. 1, but showing the core layer being cast before the coating layers.

In DC casting apparatus of the kind shown in FIGS. 1 and 2, it is usual to provide a generally rectangular mold having two long faces and two shorter ends. This produces a rectangular ingot having two opposed large rolling faces and two opposed narrow ends. The skimmer of the exemplary embodiments is preferably positioned parallel to the long faces of the mold and close to a mold wall or divider wall. The mold walls and divider walls are where the faces of the ingot, or the metal-metal interfaces, are formed during casting and where protection from floating oxide or debris is desired. The distance of the skimmer from the adjacent mold wall or divider wall is usually determined on the following basis. The skimmer may be positioned anywhere within a molten metal compartment of the casting mold as any contact with the metal oxide may have a restraining effect. However, it is preferably positioned close to the mold wall or divider wall, and more preferably as close as possible without causing any contact or congestion in this part of the mold, provided the spacing is not so close that unusual cooling characteristics or metal flow is caused. Clearly, the closer the skimmer is to the mold wall or divider wall, the more protection will be obtained from surface oxide or debris formed on the remainder of the surface of the molten metal. Normally, the spacing from the mold wall or divider wall is no more than about 5 cm, and is preferably no more than about 3 cm, with a most preferred range of 3 mm to 15 mm, but it may vary from this as circumstances dictate.

The skimmer is preferably made from a heat-insulating material that resists attack by the molten metal with which it is to be used. The use of a heat-insulating material reduces the withdrawal of heat from the molten metal, especially when the skimmer is supported from a chilled mold wall or divider wall, and thus helps to avoid the undesirable formation of pre-solidified crystalline structures in the molten metal. Preferably, the skimmer is made from a non-metallic material, and ideally an unreactive, low expansion, thermal shock-resistant, non-wetting (to the molten metal), insulating ceramic material, e.g. a composite laminated zirconium oxide-based refractory material called RSLE-57®. This material may be obtained from Zircar Refractory Composites, Inc. of Florida, N.Y. 10921, U.S.A.

While it may be desirable to protect every major face or metal-metal interface of an ingot from oxide contamination by providing a skimmer adjacent to each long mold wall or divider wall, thereby requiring two skimmers in each feed chamber of the mold, it is generally more usual to protect only one or two such faces where particular problems are likely to be caused by the presence of oxide or debris. Indeed, in some cases, only a part of a major face or metal-metal interface may require protection. For example, when casting some ingots, it is noticed that there is a reduction of interfacial adhesion only towards the longitudinal ends of the ingot and the adhesion at the center is adequate. This may be because the longitudinal ends of the ingot have more exposure to primary and secondary cooling and are thus cooled more quickly than the center of the ingot. Consequently, instead of providing a single skimmer extending fully from one shorter edge of the mold to the other, two separate short skimmers may be provided, each one extending a short distance inwardly from a shorter edge of the mold covering the region where adhesion problems occur but leaving a gap in the skimmer at the center of the mold. Although it may be expected that the surface oxide would bypass such skimmers by moving around their innermost ends to the positions requiring protection, it has been found that surface oxide and debris tends to move directly from the centerline of the metal pool at right angles towards the nearest long side of the mold, so two separate short skimmers provide adequate protection against the movement of oxide and debris into the areas requiring protection. Alternatively, there may be situations where only the central part of an ingot face or metal-metal interface requires protection from oxide, so a short central skimmer (not extending to the ends of the mold) may be used in such cases.

It is also the case that some metals may require less protection from surface oxide and debris than others, so only the pools of metal requiring such protection need be provided with one or more skimmers. For example, aluminum alloys containing 0.5% by weight or more of magnesium are, in particular, in need of protection from surface oxide.

The skimmers may be supported within the mold in any convenient way that leaves their lower ends free to dip into the molten metal surface. Conveniently, however, the skimmers may be supported from the adjacent divider walls or the mold walls. The divider walls in apparatus of the above kind have a fixed height in the mold during casting and therefore provide an effective support for the skimmers. Some form of heat insulation or thermal break should desirably be provided between the skimmers and the divider walls or mold walls because the walls may be cooled or chilled and, for the reasons given above, it is undesirable to remove significant amounts of heat from the molten metal via the skimmers. In preferred embodiments, the skimmer may be provided with at least two through-holes and elongated bolts or screws may be passed through the holes and used to attach the skimmer to a divider wall or mold wall. The bolts or screws may be provided with insulating spacers or washers both to space the skimmers from the divider walls or mold walls by a suitable distance and to provide a thermal break. Preferably, the attachment may be by screws fitting into machined and threaded through-holes in a divider wall. Ideally, the manner of attachment of the skimmers allows the skimmers to move up by a certain distance from an operating position. This avoids problems during the start of molding operations when the bottom block abuts against the lower ends of the divider walls in order to form closed compartments required to avoid metal mixing until a degree of metal solidification has taken place. Because the skimmers hang lower than the divider walls, they must be capable of moving up when the bottom block is raised to the start position. Such vertical motion can be accommodated by passing the bolts, screws, etc., used to attach the skimmers to the divider walls or mold walls loosely through vertically elongated slots in the skimmers. The upper ends of the elongated slots provide the index position that determines the position of the bottom end of the skimmer during normal use, but the bottom block may push the skimmers upwardly from these positions when needed.

In some forms of molding apparatus, divider walls may flex or change shape at different times in the molding operation, e.g. when providing compensation for butt-swelling during the initial phase of casting. If such a divider wall is used to support an adjacent skimmer, then only the parts of the divider wall that do not change shape or position should be used for the support, otherwise the skimmer may be cracked or broken as the divider wall moves. Alternatively, the skimmer may be provided with horizontally extended slots for receiving the attaching bolts and screws. The slots then allow a suitably flexible skimmer to follow the change in shape of the divider wall without cracking or breaking.

When casting apparatus is used for one-sided cladding of a core layer, the apparatus of FIG. 1 or FIG. 2 may be employed, but with one of the divider walls raised out of the operating position, and the metal levels adjusted if required. If it is desired to protect the unclad face of the ingot from oxide entrainment in such an apparatus, a skimmer may be provided adjacent to the mold wall on the unclad side of the mold. The skimmer may be supported from the raised divider wall, so there is no need to contemplate attachment of the skimmer to the mold wall itself.

Figure 3:
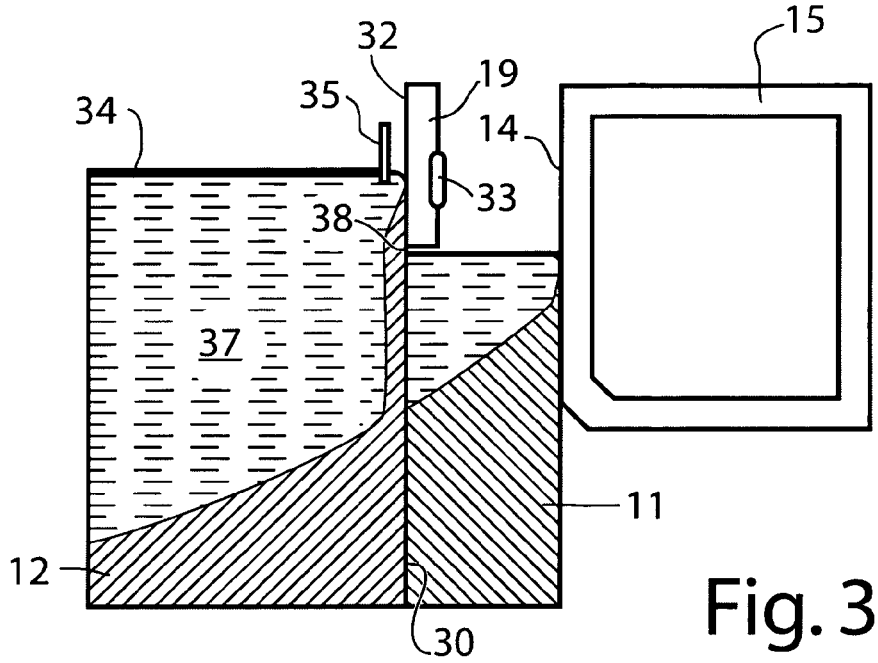
FIG. 3 is a partial view of a right hand side of an apparatus similar to FIG. 2, but showing the use of a skimmer according to a preferred exemplary embodiment.
Figure 4:
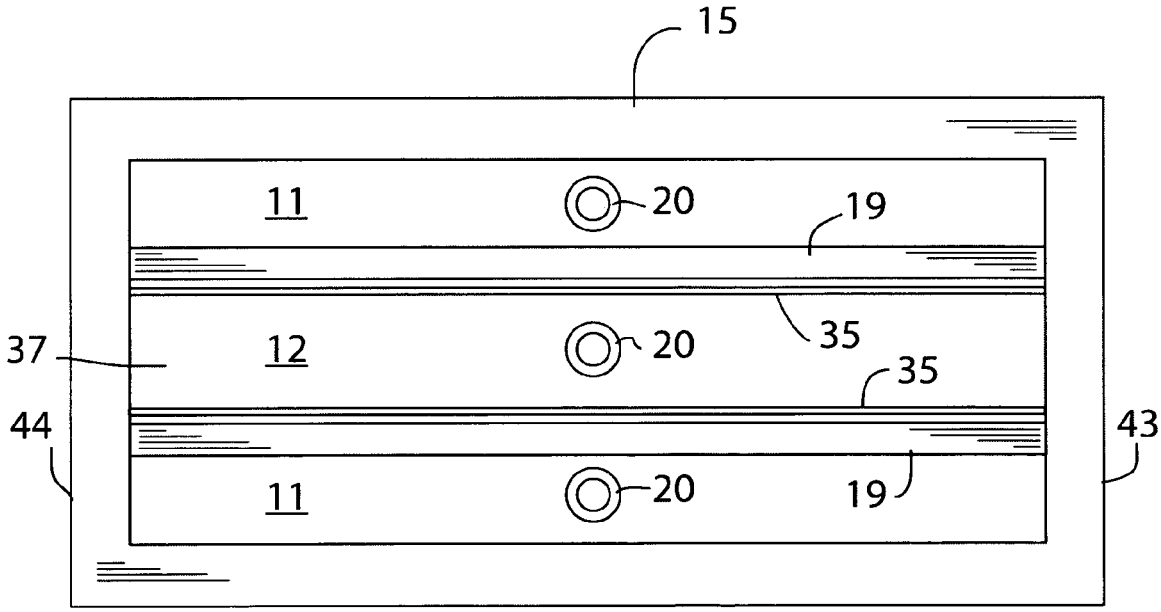
FIG. 4 is a plan view of the apparatus of FIG. 3.

FIGS. 3 and 4 of the accompanying drawings show two preferred casting arrangements in which one or more skimmers are employed. These figures show just one side of an apparatus of the kind shown in FIG. 1 or FIG. 2. The other side may be a mirror image of the illustrated part. Again, it is stated that the casting apparatus of FIGS. 1 and 2 is merely exemplary of the co-casting apparatus with which the exemplary embodiments may be employed, and the exemplary embodiments may be used with co-casting apparatus that employs either simultaneous or sequential co-casting, with cooled or un-cooled divider walls or a continuously-fed divider (sheet or strip) that is incorporated into the ingot. However, the kind of casting apparatus shown in FIGS. 1 and 2 is currently preferred for use with the exemplary embodiments and is illustrated in the drawings.

In FIG. 3, a core layer 12 is cast first and then a cladding layer 11 is cast onto a surface of the core layer. In this arrangement, surface oxide formed on surface 34 of the molten core metal 37 may be drawn onto the newly formed face 38 and then proceeds across the upper surface of the cladding layer 11 and onto the outside face of the ingot beneath the mold 15. Because the oxide has this means of escape, there is a reduced tendency for the oxide to penetrate the metal-metal interface 30, but it is desirable to protect the outer face of the ingot from the presence of the oxide from the core. A skimmer 35 is therefore positioned closely adjacent to an inner surface 32 of a divider wall 19 provided with a cooling channel 33. Therefore, the metal oxide formed on upper surface 34 of the core metal pool 37 inwardly of the skimmer 35, which may have a thickness of, for example, 50 to 2000 Angstroms, is blocked from movement into the region adjacent to the divider wall 19 and thus cannot proceed down the surface 38 and across the surface of the cladding layer 11. This limits the amount of oxide present between the cladding layer and the mold 15 as the cladding layer 11 is being cast.

FIG. 4 is a plan view of the apparatus of FIG. 3 showing that the skimmers 35 are provided at each side of the pool 37 of metal for the core layer 12 and that the skimmers extend fully along casting mold from one short side 43 thereof to the other 44, and that they parallel divider walls 19 and are spaced slightly from the divider walls. Molten metal is fed continuously into the compartments through metal delivery conduits 20.

Figure 5:
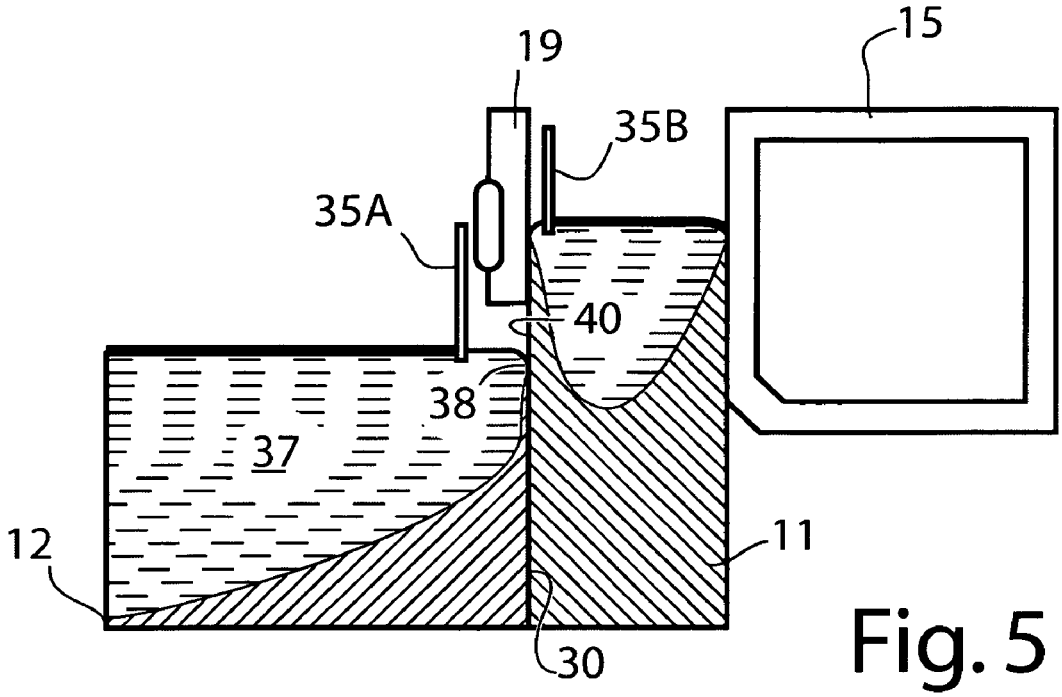
FIG. 5 is a partial view of a right hand side of an apparatus similar to FIG. 1, but showing the use of skimmers according to a preferred exemplary embodiment.

FIG. 5 shows an arrangement (referred to as the "reverse chill" arrangement) in which the cladding layer 11 is cast first and the core layer 12 is cast onto a surface of the cladding layer 11. In this case, oxide formed on the metal 37 of the core layer cannot escape across the surface of the cladding layer 11 (which is higher) and may therefore be drawn down the newly formed inner face 38 of the core layer and penetrate the metal-metal interface 30. This may also be true of oxide formed on the surface of the cladding layer 11 which may be drawn down the newly formed inner face 40 of the cladding layer. In order to protect the metal-metal interface from oxide entrainment in this way, two skimmers 35A and 35B are positioned one on each side of the divider wall 19. These skimmers reduce or eliminate oxide being drawn onto the newly formed face 40 of the cladding layer 11 and the newly formed face 38 of the core layer 12 and thus into the metal-metal interface 30. In this "reverse chill" arrangement, the metal for the core 12 may be, for example, aluminum alloy AA3004, and the metal for the cladding layers 11 may be, for example, aluminum alloys 7072 to produce culvert stock.

Figure 6:
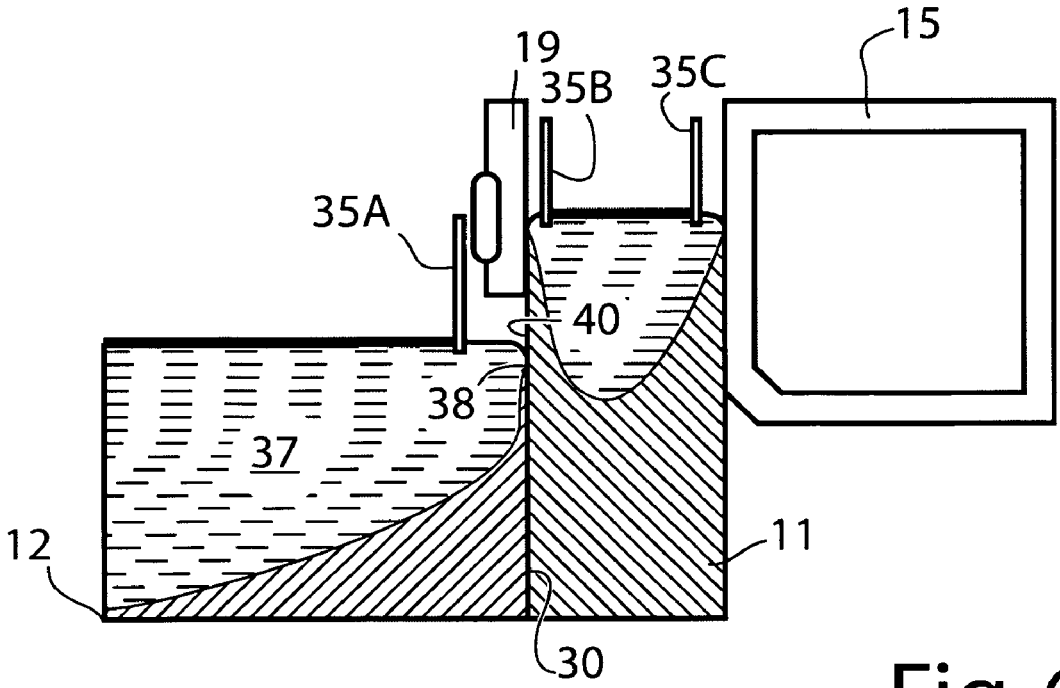
FIG. 6 is a view similar to FIG. 5 but showing an embodiment having an additional skimmer.

FIG. 6 is an arrangement similar to that of FIG. 5, except that a further skimmer 35C has been added in the cladding layer adjacent to the wall of the mold 15. This further prevents oxide formed on the surface of the cladding layer 11 from being drawn down onto the outer face of the ingot between the cladding layer 11 and the mold 15.

Figure 7:
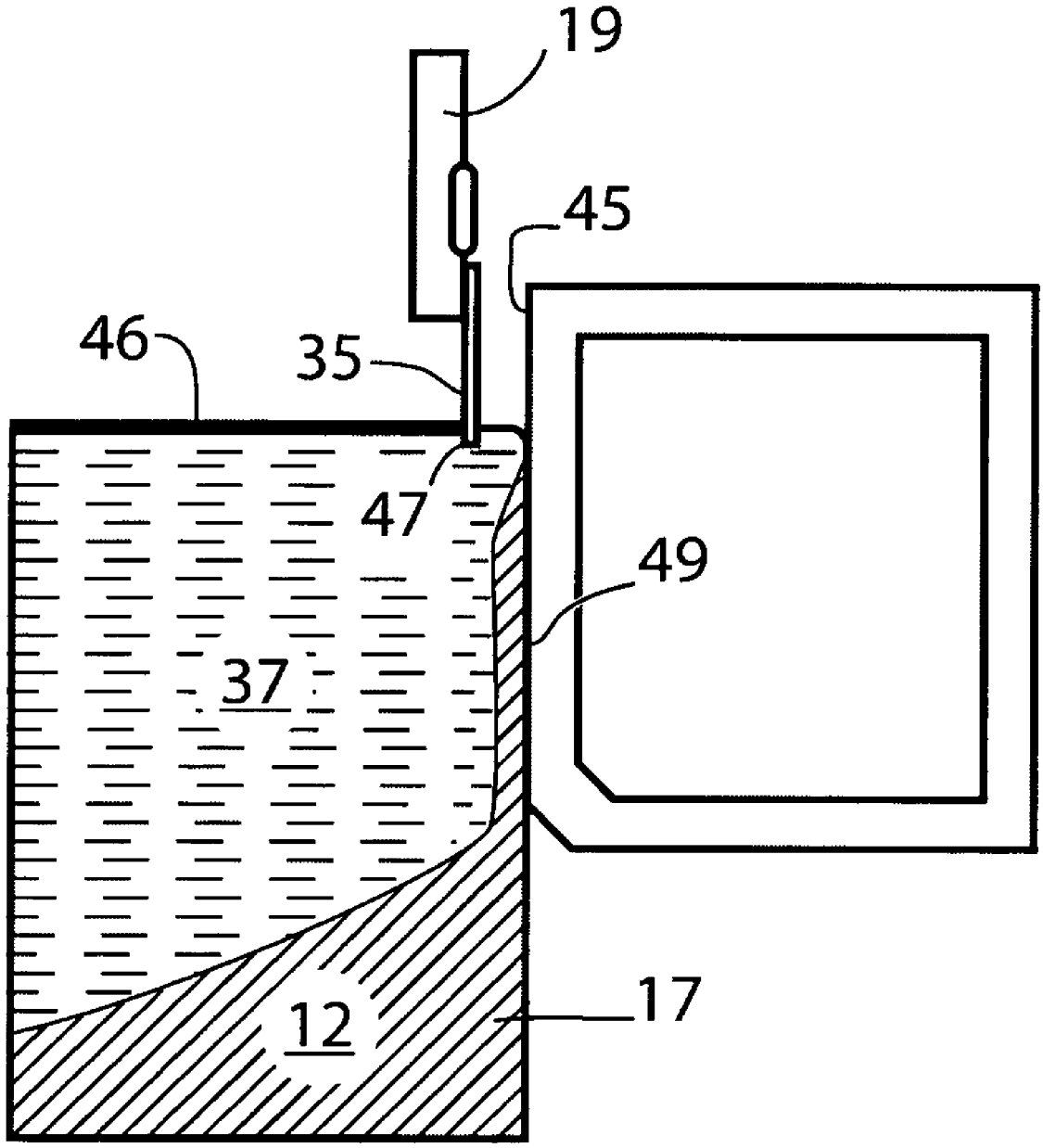
FIG. 7 is a view similar to FIG. 3, but showing a raised divider wall and attached skimmer, used for forming an ingot with a single core layer and a single cladding layer.

FIG. 7 shows an arrangement in which there is no cladding on the right hand side of the cast ingot (but a cladding layer (not shown) is provided on the left hand side). For this reason, divider wall 19 is raised from its normal operating position and may be moved laterally closer to the sidewall of the mold 45. A skimmer 35 is attached to the raised divider wall 19 and it has a length sufficient for the lower end 47 to penetrate the upper surface 46 of the core metal pool 37. Since the divider wall is not used, it is also not chilled. Consequently, the skimmer may be attached directly to the divider wall 19 without providing any kind of spacer or thermal break. The skimmer 35 protects from oxide entrainment the outer face 49 of the ingot 17 as it is formed, which makes the surface less likely to crack or break. Single-sided clad ingots formed in this way may be used, for example, to produce brazing sheet for heat exchanger tubes. The unclad side of the core layer forms in interior of the heat exchanger exposed to the cooling medium. Alloy AA3003 may be used for the core layer and alloys AA4343 or 4045 may be used for the single cladding layer. These core alloys are especially prone to cracking at the exposed surface during casting and thus benefit from the exemplary embodiment illustrated.

Figure 8:
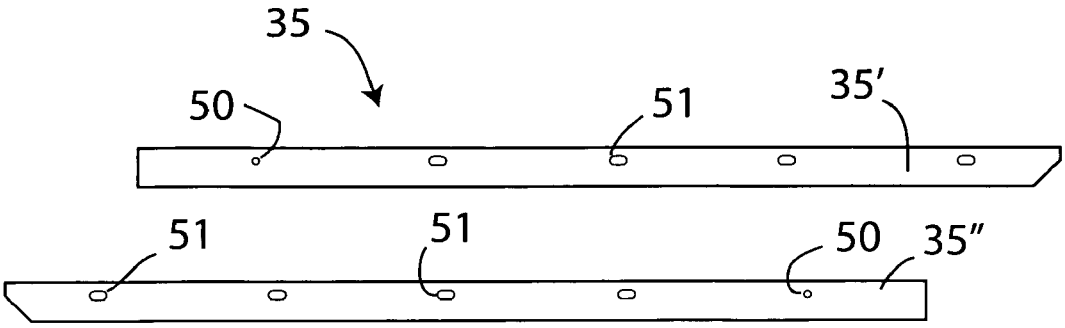
FIGS. 8 and 9 are side views of alternate designs for skimmers according to the exemplary embodiments.
Figure 9:
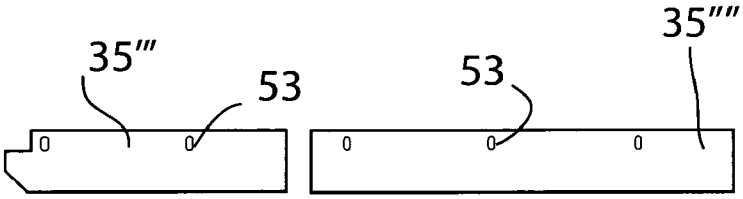
Figure 10:
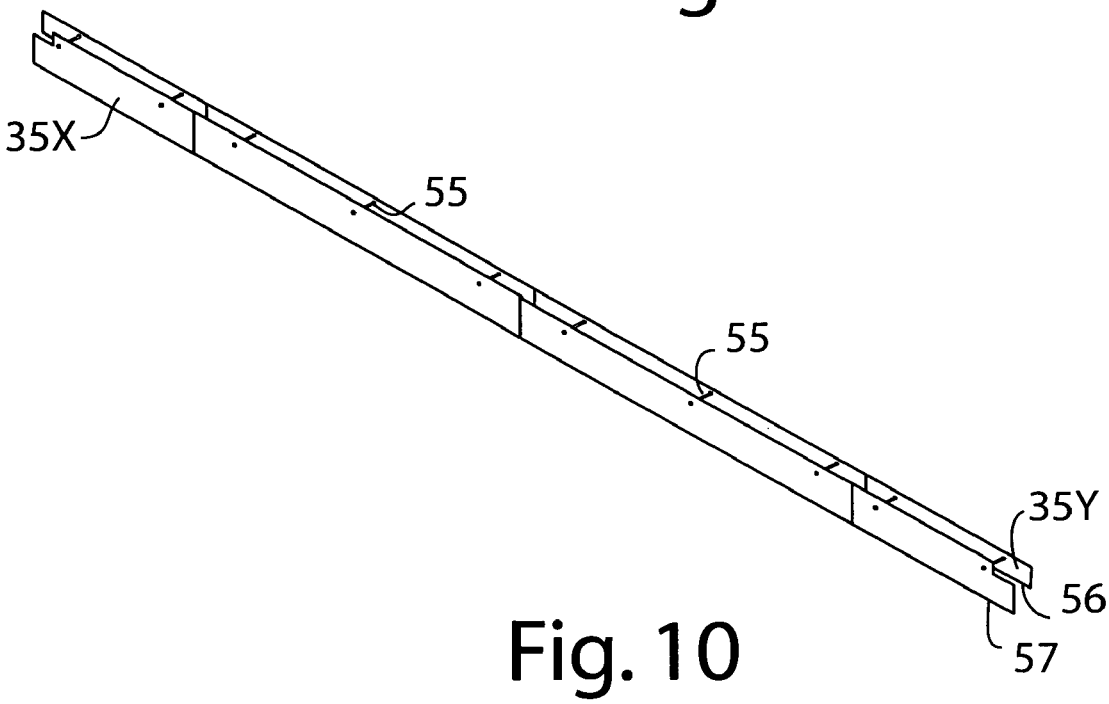
FIG. 10 is a perspective view of two skimmers of different design attached together as they would be in a preferred exemplary embodiment.

FIGS. 8, 9 and 10 are views showing different designs of skimmers. FIG. 8 shows a design that is particularly suited for use on the cladding side of a divider wall. The full length skimmer 35 consists of two parts 35' and 35" of equal length. These two parts are placed into abutting contact at the center and rigidly attached to a divider wall at this position e.g. by bolts or screws passing through small circular holes 50. The remaining points of attachment are not rigid, and may be accomplished by bolts or screws passing through horizontally elongated slots 51 that allow a degree of horizontal movement between the skimmer and the divider wall. This accommodates an outward convex flexing of the divider wall during casting. The dimensions between the attachment points essentially lengthen in response to the flexing and damage to the skimmer 35 (such as fracture or being pulled apart) is avoided.

FIG. 9 shows a skimmer 35 (shown in part) made of multiple small pieces of two kinds, shown as 35''' and 35''''. Piece 35''' is an end piece and piece 35'''' is an internal piece. A skimmer of any appropriate length can be formed by joining such pieces together with an end piece 35''' at each end of the skimmer. This design is particularly suited for use on the core side of a divider wall. In a version that is not required to drop down below the bottom edge of a divider wall, the pieces may be provided with circular holes that are slightly larger than the diameters of the fasteners (e.g. bolts or screws) used to secure the pieces to the divider wall. This allows some limited movement as the divider wall flexes during casting. Since core side skimmers experience only inwardly concave flexing during casting, which puts them under compression, the degree of permissible movement does not have to be as great as for the cladding side skimmers. In the illustrated embodiment of FIG. 9, attachment holes 53 are in the form of vertically elongated slots to allow a degree of upward and downward movement. This design is used when the bottom edge of the skimmer extends below the bottom edge of the divider wall to which it is attached, thereby requiring retraction during the start-up procedure.

FIG. 10 shows two skimmers 35X and 35Y joined together by bolts 55. These skimmers may be positioned on opposite sides of a divider wall (not shown) and their bottom edges 56 and 57 are positioned at different vertical heights to match the different heights of the surfaces of metal pools on each side of the divider wall.

Figure 11:
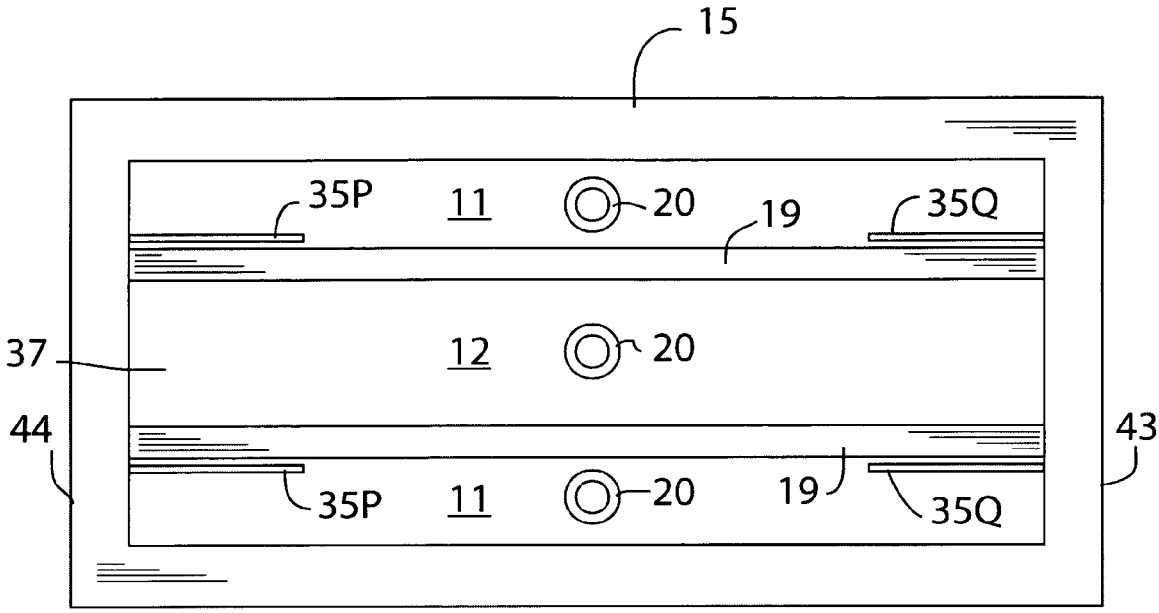
FIG. 11 is a plan view similar to FIG. 4, but illustrating a further alternative exemplary embodiment.

FIG. 11 is a plan view of the casting arrangement of FIG. 5 except illustrating an exemplary embodiment in which two short skimmer pairs 35P and 35Q are employed in each cladding layer adjacent to the divider walls 19, rather than a single continuous skimmer extending fully from one short side 43 of the mold to the other 44. These skimmer pairs protect the metal interface between layers 11 and 12 from the adverse effects of surface oxide contamination only at the longitudinal edges of the cast ingot where interfacial adhesion is more vulnerable for the illustrated embodiment.

In apparatus where the divider is movable and is fed continuously into the mold to become incorporated into the cast ingot, a skimmer positioned adjacent to the divider cannot of course be supported from or attached to the divider itself. Instead, the skimmer may be attached to the mold wall adjacent to its longitudinal ends (short sides), or may be attached to other means of support provided at the inlet of the mold, e.g. a superstructure attached to the mold or other external equipment.

Ingots have been successfully cast in apparatus of the kind shown in FIGS. 3 and 4 using the alloy combinations mentioned in the description of these figures. The arrangement of FIG. 3 gave ingots having reduced tendency to crack at the outer ingot surface and the arrangement of FIG. 4 gave ingots having good bonds at the metal-metal interface 30. In contrast, ultrasound results showed that when oxide penetrated into the interface during casting according to other arrangements, the interface was not well bonded (interface clearly visible in the ultrasound result).

Also, when skimmers 35 were removed from an arrangement according to FIG. 3, it was observed that oxide went alternatively down one face and then the other of the ingot as it was cast.

What we claim is:

1. Apparatus for casting a composite metal ingot, comprising:

an open ended annular mold having a feed end, an exit end, a cooled mold wall between said feed end and said exit end, and a moveable bottom block adapted to fit within the exit end and movable in a direction along the axis of the annular mold, wherein the feed end of the mold is divided into at least two separate feed chambers, each feed chamber being adjacent at least one other feed chamber, and where adjacent pairs of feed chambers are separated by a divider;

a feed device for delivering metal to each feed chamber to form a pool of molten metal in each feed chamber during casting, each pool having an upper surface maintained at a predetermined vertical height, and a surface oxide skimmer supported on said divider separating said adjacent pairs of feed chambers and extending into one of said feed chambers from above, said skimmer having a lower end positioned during casting at or below the predetermined vertical height of said upper surface of the pool of molten metal of said one of said feed chamber.

2. The apparatus of claim 1 having one or more additional surface oxide skimmers descending into said one or another of said feed chambers and each having a lower end positioned at or below said predetermined vertical height of said metal pool in said one or another of said feed chambers.

3. The apparatus of claim 1, wherein said surface oxide skimmer is positioned adjacent to said divider.

4. The apparatus of claim 1, wherein said surface oxide skimmer is positioned adjacent to said cooled mold wall.

5. The apparatus of claim 3, wherein said surface oxide skimmer is spaced from said divider by a distance of 5 cm or less.

6. The apparatus of claim 4, wherein said surface oxide skimmer is spaced from said cooled mold wall by a distance of 5 cm or less.

7. The apparatus of claim 1, wherein said lower end of said surface oxide skimmer is positioned below the predetermined vertical height of said upper surface by a distance up to 8 mm.

8. The apparatus of claim 1, wherein said skimmer is made of a heat-insulating refractory material.

9. The apparatus of claim 1, wherein said skimmer extends fully across said feed chamber.

10. The apparatus of claim 1, wherein said skimmer extends only partially across said feed chamber.

11. The apparatus of claim 1, wherein said skimmer is supported on said cooled mold wall.

12. The apparatus of claim 1, wherein said divider is a cooled divider wall.

* * * * *